US009211544B2

(12) United States Patent
Lowe

(10) Patent No.: US 9,211,544 B2
(45) Date of Patent: Dec. 15, 2015

(54) ORGANIC SHREDDER APPARATUS AND METHOD FOR OPERATING AN ORGANIC SHREDDER

(71) Applicant: Liquid Environmental Solutions, San Diego, CA (US)

(72) Inventor: Shelby Lowe, Houston, TX (US)

(73) Assignee: Liquid Environmental Solutions, San Diego, CA (US)

( * ) Notice: Subject to any disclaimer, the term of this patent is extended or adjusted under 35 U.S.C. 154(b) by 0 days.

(21) Appl. No.: 14/687,379

(22) Filed: Apr. 15, 2015

(65) Prior Publication Data

US 2015/0217296 A1 Aug. 6, 2015

Related U.S. Application Data

(62) Division of application No. 13/480,158, filed on May 24, 2012, now Pat. No. 9,010,667.

(51) Int. Cl.

| | |
|---|---|
| ***B02C 9/04*** | (2006.01) |
| ***B02C 18/00*** | (2006.01) |
| ***B02C 18/16*** | (2006.01) |

(52) U.S. Cl.

CPC ..... *B02C 9/04* (2013.01); *B02C 18/0084* (2013.01); *B02C 18/16* (2013.01); *B02C 2018/164* (2013.01)

(58) Field of Classification Search

CPC ..... B02C 9/04; B02C 18/0084
USPC ..... 241/30, 21, 36, 260.1, 236
See application file for complete search history.

(56) References Cited

U.S. PATENT DOCUMENTS

| | | | |
|---|---|---|---|
| 4,399,946 | A | 8/1983 | Stevenson |
| 5,568,996 | A | 10/1996 | Buehler |
| 6,311,908 | B1 | 11/2001 | Kajiyama et al. |
| 2004/0129807 | A1 | 7/2004 | Phillips et al. |
| 2010/0078512 | A1 | 4/2010 | Páll et al. |

*Primary Examiner* — Mark Rosenbaum
(74) *Attorney, Agent, or Firm* — Crowell & Moring LLP

(57) ABSTRACT

An apparatus and method is provided for organic material reduction and preparation for subsequent recycling or disposal in a self-contained system which is safe for equipment operators, and highly cost and floor-space efficient. The apparatus includes a preferably-shaped hopper for receiving organic materials to the reduced, preferably a floating auger, a solids pump and a macerator. The system preferably generates a processed organic material discharge with a particle size on the order of ⅛" without concern as to the liquid content of the incoming organic material. The apparatus may be operated by a method which is completely automated following operator initiation, including automatically attempting self-clearing actions in the event of detecting clogs or jams in the processing components.

4 Claims, 7 Drawing Sheets

ORGANIC SHREDDER APPARATUS AND METHOD FOR OPERATING AN ORGANIC SHREDDER

CROSS REFERENCE TO RELATED APPLICATIONS

This application is a divisional of U.S. application Ser. No. 13/480,158, filed on May 24, 2012, the disclosure of which is expressly incorporated by reference herein.

The present invention relates to an apparatus and method for processing organic materials such as food waste. In particular, the present invention relates to organic material reduction and preparation for subsequent recycling or disposal in a self-contained, automated system which is safe for equipment operators, highly cost and floor-space efficient, and highly scalable for use in both large and small facilities, such as retail store back-room operations.

BACKGROUND OF THE INVENTION

In the field of waste processing, recycling and disposal, organic material disposal is a source of numerous challenges.

Food products difficult due to wide variety of shapes, sizes, textures, variations in density in internal and external regions, and variations in water content. For example, bread products present a particular problem for automated waste disposal due to their low moisture content and constituents which tend to be self-adhesive and jam mechanical devices, unless substantial water is added to the bread shredding process.

Another difficulty in organic waste stream processing is providing a single material handling arrangement which can simultaneously and efficiently handle organic materials as diverse as small, soft tomatoes and large, smooth surfaced watermelons, where watermelons tend to simply "ride" on top of material handling equipment sized to handle smaller organic materials. Similarly, the single mechanical arrangement must be capable of providing a consistent flow of material into the processing equipment to provide for efficient and smooth operation of the downstream organic material reduction equipment and to avoid problems with blockages forming in the equipment. Water may be injected into the organic material to help avoid clogging and to otherwise lubricate and cool components during processing, however, this approach has several disadvantages, including requiring provision of piping and connection to a water source, use of large volumes of water (water which continues to increase in cost and may relatively scarce in some regions), and increasing the volume of processed material ultimately requiring disposal at a time in which the cost per unit volume of waste disposal at commercial and municipal facilities is rapidly rising. Further, even where water may be readily available, its use reduces the breadth of organic materials which may be processed, as some materials are not amenable to addition of water during processing. Moreover, water is a costly resource and its use reduces savings from recycling.

On-site organic material processing also requires a significant investment in personnel training on system operation and associated safety hazards. Personnel costs are further increased by the need to devote a significant amount of employee time to operating and monitoring the processing equipment, as well as performing maintenance such as disassembly of components to clear blockages—activities which inherently carry additional risks of operator injury.

Due to the problems inherent in attempting to process a wide variety of organic materials on-site, on-site organic material processing is rarely economically viable, and often is associated with concomitant issues, such as unpleasant odors from decaying organic material, related health concerns, and creation of undesired pest (inset and/or mammal) attraction and intrusion in either indoor or outdoor storage containers. Accordingly, virtually all processing of organic waste from restaurants, grocery stores, institutional facilities and the like is handled offsite, with only temporary on-site holding of the organic material for pick-up and transport to an off-site processing facility and/or waste disposal unit (such as a landfill, compost facility or waste water treatment plant).

The present invention solves the foregoing and related problems in the prior art by providing a unique combination of components and an operating method to produce a system with several advantages, including: a lack of need for water addition to process organic materials, regardless of their source; the ability to produce a fine particle-size discharge which is readily transferred for storage, off-site transfer, recycling and/or disposal; the ability to substantially reduce the volume of the processed organic material to minimize volume-based storage, transportation hauls and disposal costs; the ability of readily simultaneously handle a large variety of organic material sizes, geometries textures and densities without the need for any machine adjustments; and the ability to operate in a self-contained, fully enclosed, autonomous manner after loading, with minimal operator training requirements and a high degree of operator safety. Further, the system may be provided with automated flow disruption self-diagnosis capabilities and the ability to attempt to self-clear clogs and equipment jams before initiating a protective self-shutdown. The system also provides for sanitary and virtually odor-free storage of the processed organic material until the material is removed for off-site handling. The system of the present invention is further capable of processing very large volumes of organic material in a short period of time (such as may be generated at food processing facilities, restuarants or grocery stores) and do so at relatively low equipment noise levels, thereby minimizing energy consumption and facility environment disturbance.

The present invention combines an organic material delivery hopper, preferably with a preferred geometry which facilitates efficient feeding of the organic material, an auger unit for initial crushing and feed transport of organic materials into a further processing unit, where the auger unit has at least one "floating" end which is free to move in a direction transverse to the longitudinal axis of the auger to aid in break-down of the incoming organic material, the further processing unit comprising a solids pump and organic material reduction device, where the solids pump is preferably a positive displacement twin rotor pump which is capable of transferring both solid and liquid materials received from the floating auger into the reducing unit, and the reducing unit preferably is a macerator capable of receiving the positive pressure organic material flow from the solids pump and reducing the material at high speed and high pressure to a finely-processed flow (preferably using any moisture containing in the organic material to form a slurry) which may be sent under positive pressure to a storage facility, preferably an adjacent storage tank, for holding prior to subsequent withdrawal and further off-site processing. The location of a solids pump before a macerator, contrary to common arrangements with a pump downstream of a organic material shredding device, provides a particularly efficient and compact arrangement of components and the generation of a relatively high velocity and high pressure processed organic material stream being discharged from the macerator.

The system may scaled as desired to match the desired processing capability to the expected amount of organic material requiring disposal. For example, a system generally sufficient to handle the volume of organic material which typically is processed for disposal at a large grocery store may be provided in a single enclosure approximately 8 feet long, 3 feet wide and less than 4 feet tall, coupled with an adjacent fiber-reinforced plastic storage tank to receive the processed organic material. The tank may be located inside or outside of the facility. Such a system configuration minimizes the amount of facility floor space required in the store, while also ensuring a sufficiently low lift-height for loading to minimize the potential for lifting-related injury as the operator loads the hopper.

The system is also preferably designed to have a movable cover, such as a sliding top hatch, which may be opened to load in the organic material to be processed, and fitted with at least one interlock (mechanical or electrical/electronic) which prevents system operation when the movable cover is open. Similar safety interlocks may be provided for removable panels on the system enclosure provided for access to the system components for component servicing. So equipped, all that is required for safe operation of the system is for the operator to drop the organic material into the feed hopper, close the movable cover, and turn the system on to permit the imbedded controller to initiate the organic material processing.

An operating method of the present invention may include the placement of organic material in the hopper above the floating auger. The system is preferably provided with a bar or similar device in an upper region of the hopper on which large but relatively fragile materials such as watermelons may be impacted to fracture the material into large pieces which are less prone to rotate on top of the floating auger without entering the auger's flutes to be pushed into the solids pump.

Following the loading of the hopper, the operator moves the cover into its closed position to enable start-up of the system. The operator selects the appropriate processing commands, which may be as simple as a "start" button, and initiates the processing of the organic material. The system primary components, the floating auger, the solids pump and the macerator are then powered to begin processing the organic material in the hopper. Preferably the hopper auger, pump and macerator components are sized such that the processing of the batch of organic material in the hopper may be accomplished in less than five minutes, minimizing energy consumption and noise generation. It is preferable that the system be configured, for example by suitable programming of an electronic controller, to either shut itself down upon detection of completion of processing of the organic material loaded into the hopper (for example, by use of optical sensors detecting the absence of further processed material flow, current sensors detecting termination of load on the auger, pump and/or macerator indicative of lack of material loading, flow sensors, and the like). It is further preferable that the system be configured to operate for a limited period, such as five minutes, after which the system would shut itself down if not previously shut down upon detection of completed organic material processing.

As a part of the automated processing of the organic material following hopper loading, it is preferred that the system be configured to detect flow disturbances and/or flow blockages, for example by detection of excessive current draw in an electric motor driving one of the auger, pump and/or macerator, and in response to such a flow disruption or blockage to cause at least one of (preferably all of) the auger, pump and/or macerator to reverse direction for a period of time to attempt to self-clear the flow disruption or blockage. Further, it is preferable to have the system configured to determine following the reverse operation to determine whether the flow disruption or blockage has been cleared when operation in the forward processing direction is resumed. If the attempt as self-clearing has not been successful, the system may be programmed to repeat the reversal process one of more times (for example, three times) to again attempt to clear the blockage, as development of the present invention determined that many flow disturbances may be remedied with multiple attempts at self-clearing. In order to protect the system equipment and minimize power use and noise generation, after a final unsuccessful attempt at self-clearing the system may be configured to shut down the organic material processing, preferably with an accompanying signal to the operator that manual intervention and system clearing is needed.

Other objects, advantages and novel features of the present invention will become apparent from the following detailed description of the invention when considered in conjunction with the accompanying drawings.

DETAILED DESCRIPTION

Figure 1A:
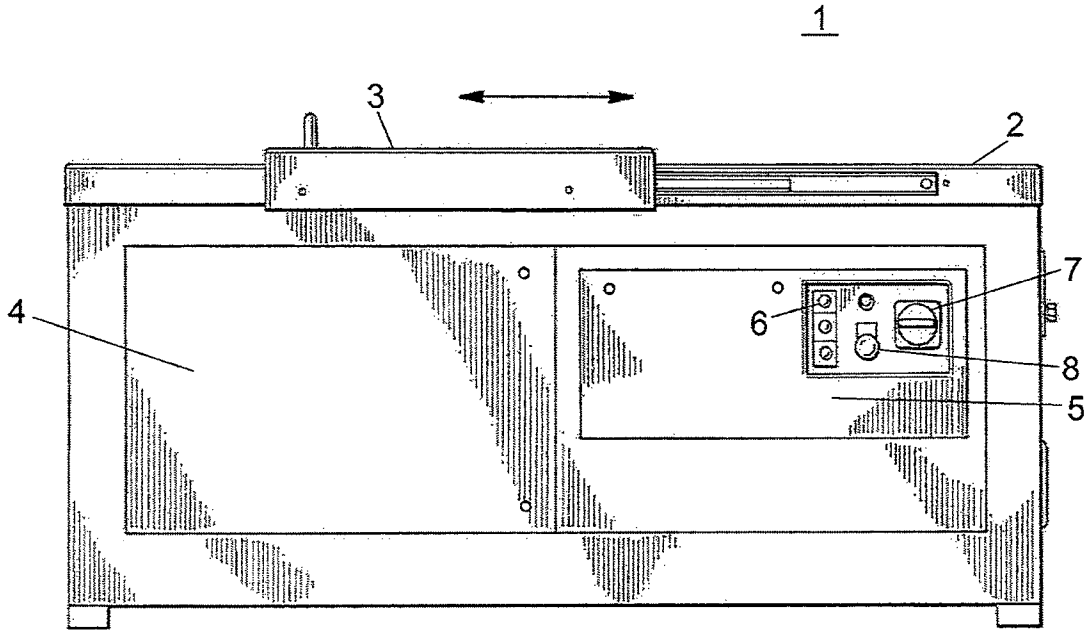
FIG. 1*a* is an elevation view of a front side of an organic shredder in accordance with an embodiment of the present invention.
Figure 1B:
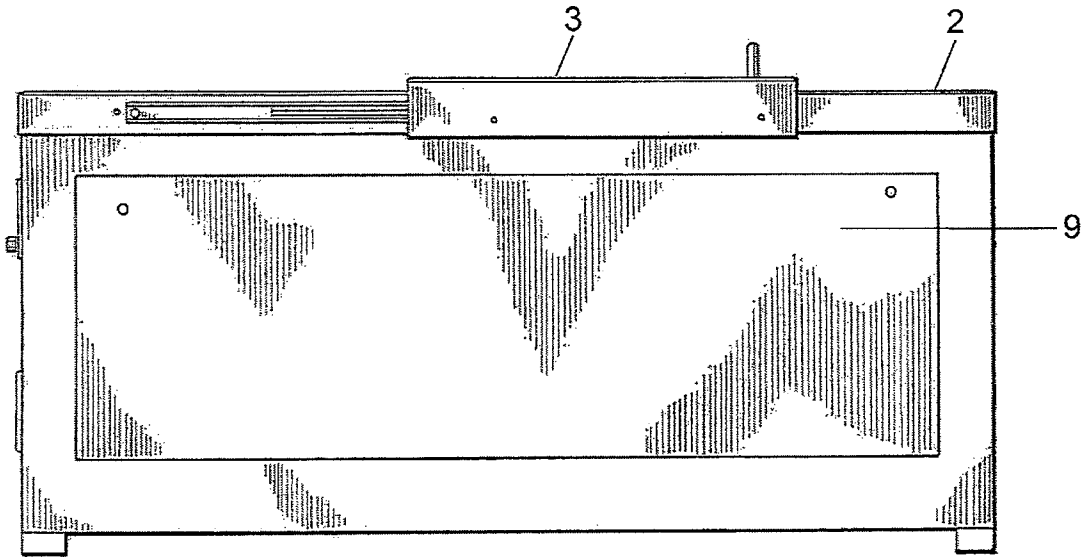
FIG. 1*b* is an elevation view of a rear side of the organic shredder in FIG. 1*a*.
Figure 1C:
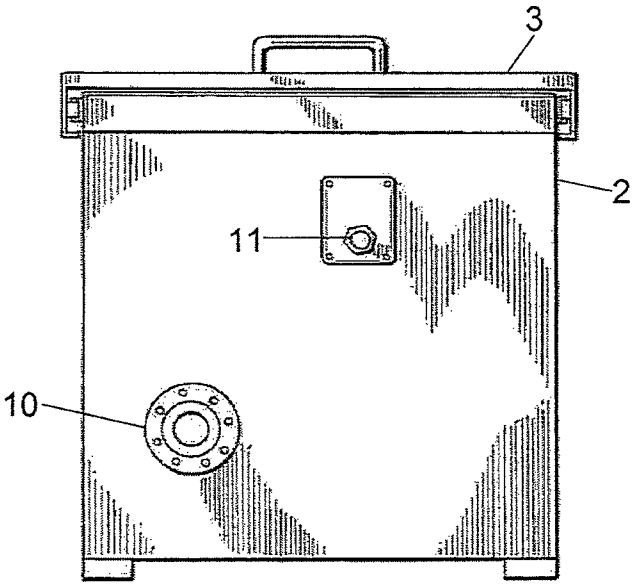
FIG. 1*c* is an elevation view of an end side of the organic shredder in FIG. 1*a*.

FIGS. 1*a*-1*c* are illustrations of an embodiment of an integrated organic shredder apparatus 1. Essentially all of the mechanical and electronic components of the integrated organic shredder apparatus 1 are contained within an enclosure 2. In this embodiment the enclosure 2 is approximately 8 feet long, 3.5 feet high, and 3 feet deep.

FIG. 1*a* shows a front elevation view of the enclosure 2. In this embodiment a hopper cover 3 on the top of the enclosure 2 in a manner which permits the cover 3 to be moved laterally to permit loading of the hopper and be closed during system operation. For operator safety reasons, the enclosure may be equipped with at least one safety interlock switch (such switches being well known in the art and thus not illustrated here) which precludes and/or disables system operation when the hopper cover 3 is not in the fully closed position. The front panel of the enclosure 2 include a mechanical access panel 4, also preferably equipped with at least one safety interlock switch to preclude and/or disable system operation. In this embodiment the front panel also includes an electrical panel 5 containing simple operator controls, such as system status lights 6, system operating switch 7 and emergency stop button 8. The electrical panel 5 may also be opened to permit access to the system control electronics and associated electrical component wiring which are co-located in an electrical compartment behind the panel 6 for convenience in service and system diagnostics. Preferably the panels are secured with a key lock system to preclude unauthorized entry.

Figure 3:
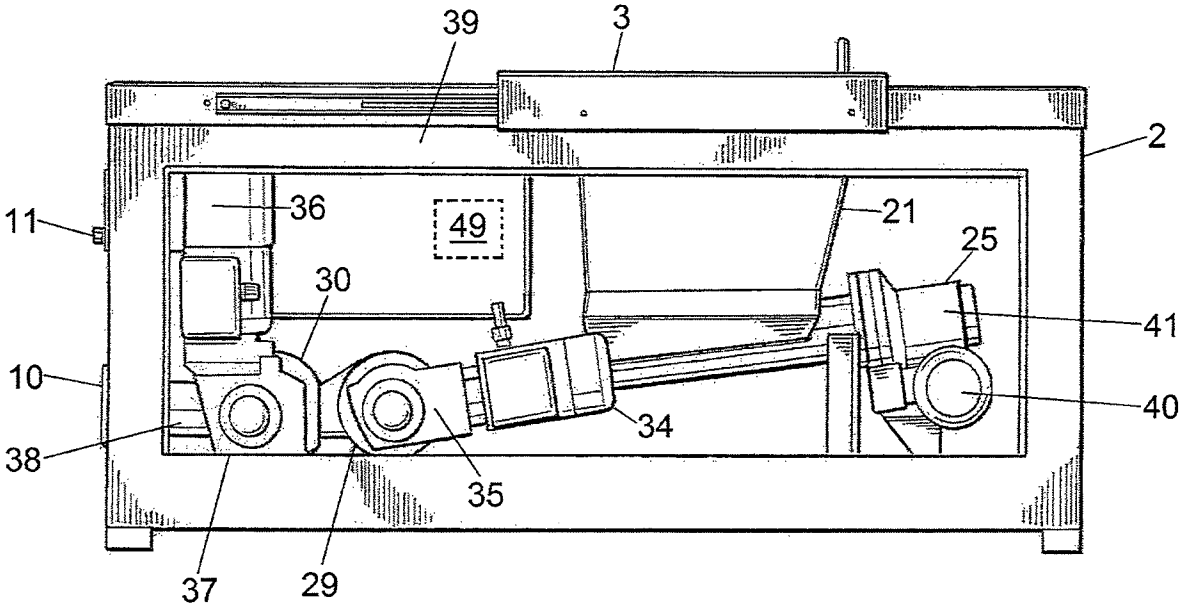
FIG. 3 is an elevation view of the rear side of the organic shredder in FIG. 1*b* with an access panel removed to show internal component arrangements.

FIG. 1*b* shows a rear elevation view of the enclosure 2, with access panel 9 being provided to readily access the mechanical components of the system, as shown in FIG. 3 and described further, below. FIG. 1*c* shows and end elevation view of the enclosure 2, with output piping flange 10 through which the processed organic material is discharged from the enclosure 2, and the electrical power input conduit connection point 11.

Figure 2:
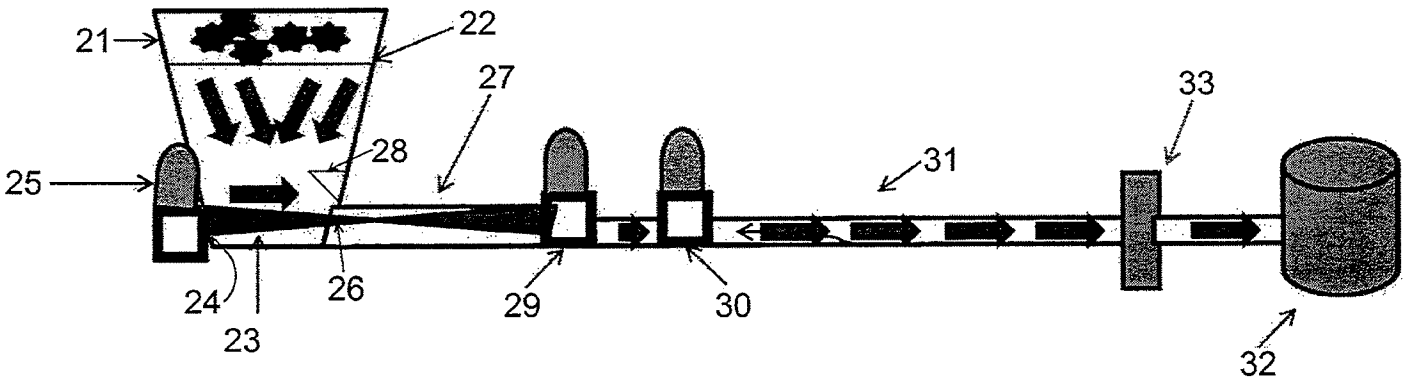
FIG. 2 is a schematic illustration of an organic shredder in accordance with an embodiment of the present invention.

FIG. 2 is a schematic illustration of the components of the organic shredder apparatus. Organic material is deposited into hopper 21 for processing. Preferably a breaker bar 22 is provided near the top of the hopper 21 to provide a stress-concentrating point of impact for initial breaking of large organic material, such as watermelons, into irregularly-shaped pieces which are more easily fed through the system.

As the organic material reaches the bottom of the hopper 21, it encounters a rotating auger 23, preferably arranged at an angle relative to the horizontal (on the order of 10-20 degrees) to aid in the auger's self-clearing at the end of processing a load of organic material. The auger's flutes are arranged to both perform initial break-up of the organic material being deposited into the hopper 21 and to push the organic material toward the outlet of the hopper.

In this embodiment the auger is a floating auger, having a first gearbox end 24 coupled to an auger drive 25, and a floating end 26 which is free to move radially within the hopper 21 and/or the entrance of a pipe 27 leading to a solids pump 29. By allowing the floating end 26 to move radially, the auger is able to more readily and efficiently perform initial break-up of large pieces of organic material and thereby avoid jamming. This improved performance is enabled by the auger's being able to: (i) move laterally to allow large organic material pieces to be drawn into the trough alongside the auger, and (ii) move upward in the circumferential direction to rise up over the organic material as the material moves under the auger. In the course of this floating auger movement, the large pieces of organic material are trapped under the auger and broken into smaller pieces. To further aid the auger in moving organic material toward the hopper outlet, an angled shelf 28 may be provided in the vicinity of the hopper output to form a pinch region to help guide the organic material above the auger down into the auger flutes.

The auger is arranged to feed an essentially constant flow of organic material through the hopper outlet into a downstream section of pipe 27 leading to a solids pump 29 capable of moving solids in large volume and at elevated pressure, regardless of the extent of the presence or absence of liquid in the material. An example of a suitable solids pump is a Model FL 776 rotary lobe pump manufactured by Borger GmbH, Borken-Weseke, Germany. The pump is preferably readily reversible by electronic control of the pump's drive motor.

The outlet of the solids pump 29 is preferably to another section of pipe 27 or directly to a downstream macerator unit 30. An example of a suitable macerator pump is a Model HFL Multicrusher macerator manufactured by Borger GmbH, Borken-Weseke, Germany. The macerator 30 is preferably equipped with at least two rotating shafts holding multiple counter-rotating circular blades capable of shredding organic material at high speed to produce an output slurry containing organic material with a particle size on the order of ⅛" or less. The macerator 30 is also preferably readily reversible by electronic control of the macerator's drive motor, and functions without regard to the amount of liquid in the organic material.

The finely shredded organic material is discharged from the macerator 30 to a pipe 31 (in this embodiment, a four inch diameter pipe) and directed to an organics storage tank 32. The storage tank 32 is preferably located outside of the building in which the enclosure 2 is located, with the pipe 31 passing through the building wall 33. Due to the processing through the auger, the solids pump and the macerator, the volume of the organic material originally deposited in the hopper 21 will have gone through an order of magnitude reduction in volume. This permits processing substantial amounts of organic material in a relatively small volume, and thereby permits extended storage times before the volume of processed material must be periodically removed from the facility. When removed from the storage tank 32, the stored organic material may be moved to a facility for further processing or directly disposed of, for example by distribution as fertilizing material or by transfer to a waste management facility. If the material is not to be reused, the substantial volume reduction during the processing will greatly reduce volume-based waste disposal charges.

As part of the controller's programming to control the auger, the solids pump and the macerator, it is preferred that the controller is programmed to control the individual components' operating speeds to suit the components' reduction gearing ratios, both to facilitate matching the organic material mass and/or volume flow rates to the feed requirements of the components, and to assist in obtaining a desired particle size output from each component.

FIG. 3 illustrates the arrangement of components within enclosure 2 corresponding to the FIG. 2 schematic illustration, with hopper 21 located directly beneath hopper cover 3 with the incorporated auger drive 25 supported thereon. The outlet of the hopper 21 is connected to a pipe connecting the hopper 21 to the solids pump 29 (the pipe is located in this view behind the electric motor 34 driving the gearbox 35 of the solids pump 29). The macerator 30 is connected to the outlet of the solids pump 29 and is similarly driven by and electric motor 36 and gearbox 37. The discharge from the organic shredder enclosure 2 passes from the macerator 30 through discharge pipe 38 and outlet flange 10. Electrical component box 39, located behind electric panel 5, contains the system control electronics and electrical components such as switches, lights, relays and wiring busses. As with the solids pump 29 and the macerator 30, in this embodiment the floating auger drive unit 25 includes and electric motor 40 and a gearbox 41.

Figure 4B:
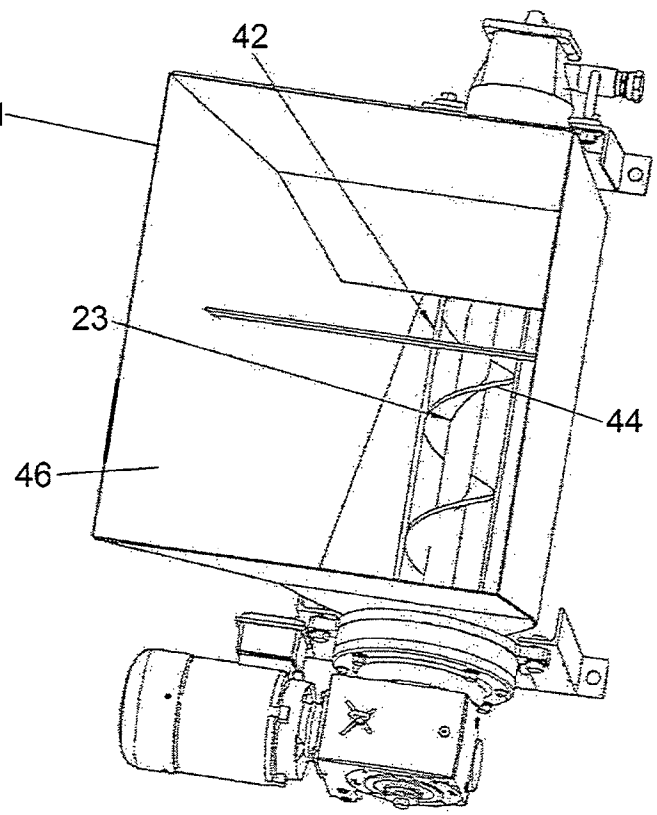
FIGS. 4*a*-4*d* are oblique, elevation and cross-section views of various aspects of a hopper in accordance with an embodiment of the present invention.
Figure 4A:
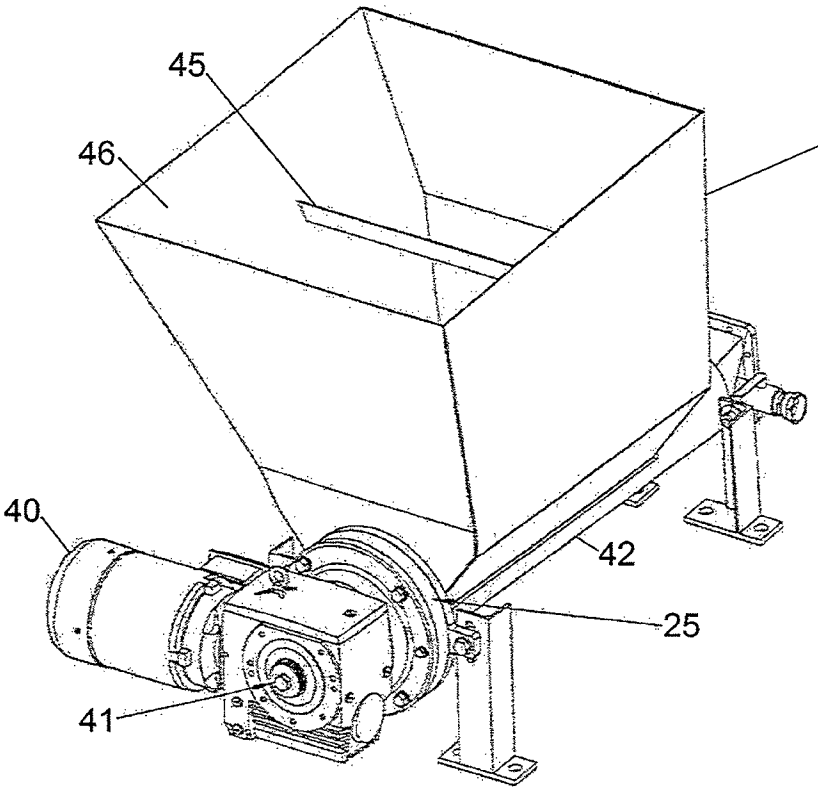
Figure 4D:
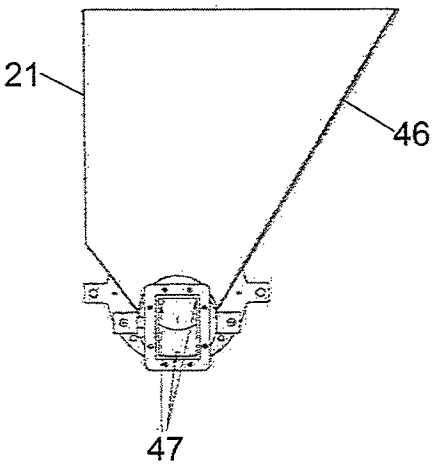
Figure 4C:
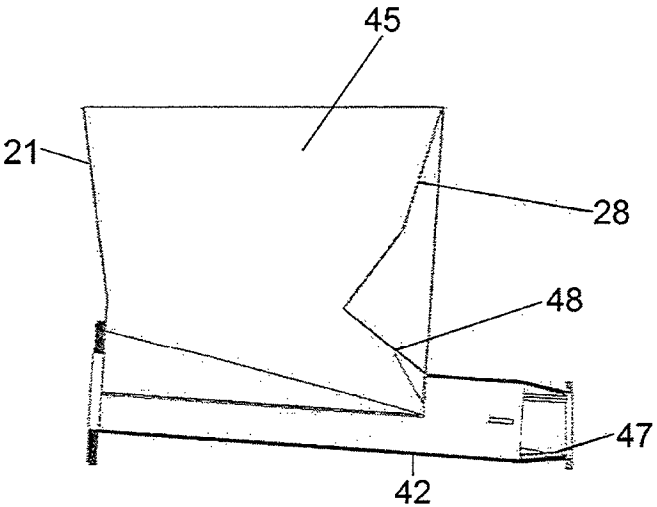

The hopper 21 is preferably formed from stainless steel to minimize corrosion and ease cleaning. FIGS. 4*a* and 4*b* show oblique views of the FIG. 3 hopper 21, floating auger 23 and the auger drive unit 24 as an assembled unit. FIGS. 4*c* and 4*d* show an elevation cross-sectional view and an elevation end view, respectively, of the hopper itself. As shown in FIG. 4*b*, the floating auger 23 lays in a trough 42, which is preferably produced from a section of pipe cut away in the region below the hopper. The trough 42 is preferably provided with a replaceable high density plastic liner 43 (in this embodiment, semi-circular in cross-section) to facilitate flow of organic material along the auger flow path toward the solids pump, and to protect the floating auger's flutes 44 and the trough 42 from mutual damage during operation.

The hopper 21 is also provided with several features which assist in improving organic material flow through the hopper to the solids pump. As shown in FIGS. 4*a*-4*d*, the hopper 21 is provided with a breaker bar 45 near the top of the hopper, on which an operator may drop organic materials which are too large and smooth-surfaced to be readily drawn into the floating auger, such as watermelons. By fracturing such large materials on the breaker bar 45 before they fall to the bottom of the hopper 21, the floating auger may more easily grip and/or break apart the material. The breaker bar thus aids in minimizing the extent of operator intervention which might be required to manually remove and/or break up material which would otherwise self-suspend itself on top of the auger flutes.

Other feed-enhancing features of the hopper 21 include a side wall 46 parallel to the intake side of the floating auger 23, which is set at an angle which promotes gravity feed and turn-over of organic materials as they approach the auger flutes 44. Preferably the angled side wall 44 is arranged at an angle in the range of approximately 10° to 45° from vertical, and particularly preferably approximately 30° from vertical. The hopper 21 may also be provided with angled shelf 28 which is positioned to assist in forcing the volume of organic material above the floating auger 23 downward into the hopper outlet 47 as the auger flutes 44 are driving the organic material forward. Small additional directing plates 48 may also be provided to direct organic material laterally adjacent to the auger flutes 44 down into the hopper outlet.

The electronic control unit 49 located within electrical box 39 is programmed to perform several functions, including: accepting and responding to operator commands; monitoring the status of safety switches (such as a hopper closure position safety switch, enclosure access panel closure safety switches and/or a storage tank level detector); controlling the supply of electrical power to the auger drive unit, the solids pump and/or the macerator; and managing automatic operation of the system components, including control of time of component operation, monitoring of components to detect jamming and/or clogging (for example, by monitoring of electric current draw by the auger, pump and/or macerator electric motors), and executing automatic reversal and processing terminating actions in response to detected operating conditions (such as: excessive electrical current draw indicating a component jam or below-minimum electric current draw indicating unloaded component operation during to an upstream clogging event; improper opening of the hopper cover or the enclosure access panels during organic material processing operation; completion of the predetermined operating program).

An example operating sequence of the organic shredder in the foregoing embodiment would include sliding the hopper cover 3 to the open position, thereby signaling the electronic controller 49 that the cover is open and operation should be inhibited. The operator would next load the hopper 21 with the organic material to be processed, breaking larger materials on the breaker bar 45 as necessary, and close the hopper cover 3. Following loading, the operator may switch on the organic material shredder with switch 7. Once signaled to start processing, and upon completion of verification that any monitored safety switch and/or detector is in the proper condition (for example, hopper cover closure switch closed, enclosure panel closure switches closed), the electronic controller may provide electrical power to the motors of the auger, solids pump and macerator to begin reduction of the organic material.

The electronic controller 49 may be programmed to follow a pre-determined processing program, such as continuous operation for a fixed maximum period, such as five minutes. Alternatively, the controller 49 may be programmed to periodically reverse flow for short period (for example, 30 seconds) at various intervals (for example, every two minutes) during the organic material processing to help ensure continued smooth flow of the organic material to the storage tank 32. Such reversals may include reversal of all the electric motors, or selective reversal of individual motors.

Reversals may also be initiated in response to an indication of clogging or jamming being detected by the controller 49. Preferably, in order to minimize the need for operator intervention and component clearing maintenance, the electronic controller 49 may be programmed to attempt to automatically self-clear clogging or jamming upon detecting a potential clogging or jamming event. For example, the controller may respond to an indication of clogging or jamming by first reversing all of the electric motors for a short period (for example, 30 seconds), then directing power in the forward direction to the electric motors while monitoring to determined whether the indication of clogging or jamming is still present. Particularly preferable is for the controller 49 to be programmed to make at least a second attempt at self-clearing if a continued clogged or jammed condition is still present by executing another electric motor reversal operation. If the clogged or jammed condition is not cleared after a predetermined number of self-clearing attempts (for example, after three attempts), the electronic controller 49 may be programmed to automatically shut down the organic shredder and provide a signal to the operator that further operator action to clear the clog or jam is required.

The foregoing disclosure has been set forth merely to illustrate the invention and is not intended to be limiting. Because such modifications of the disclosed embodiments incorporating the spirit and substance of the invention may occur to persons skilled in the art, the invention should be construed to include everything within the scope of the appended claims and equivalents thereof.

What is claimed is:

1. An method of reducing organic materials, comprising the acts of:

depositing organic material in a hopper in an organic material reducing apparatus which includes an auger which receive organic material received in the hopper, a solids pump, a macerator and a controller, wherein the solids pump is arranged to receive organic material from the auger, the macerator is arranged to receive organic material from the solids pump, and the controller is configured to control operation of the auger, the solids pump and the macerator to reduce the organic material;

initiating operation of the reducing apparatus under the control of the controller;

transferring the organic material deposited in the hopper through the auger, the solids pump and the macerator; and discharging reduced organic material from the macerator.

2. The method of claim 1, wherein the organic material reducing apparatus includes a storage container, further comprising the act of:

storing the reduced organic material discharged from the macerator in the storage container.

3. The method of claim 2, further comprising the act of:

shutting down operation of the organic material reduction apparatus automatically in the event of at least one of reaching an end of a predetermined processing period and opening of an opening of an enclosure containing at least one of the auger, the solids pump and the macerator.

4. The method of claim 3, further comprising the acts of:

monitoring operation of at least one of the auger, the solids pump and the macerator;

initiating a self-clearing reversal of at least one of the auger, the solids pump and the macerator for a pre-determined period upon detecting an indication of an organic material clog or jam in the organic material reduction apparatus; and restarting and monitoring operation of at least one of the auger, the solids pump and the macerator;

determining whether the organic material clog or jam has cleared; and if the organic material clog or jam has not cleared, at least one of repeating the self-cleaning reversal and shutting down the apparatus and issuing an operator intervention signal.

* * * * *